US006483392B1

(12) United States Patent
Fischer et al.

(10) Patent No.: US 6,483,392 B1
(45) Date of Patent: Nov. 19, 2002

(54) POLARIZER AND METHOD FOR MANUFACTURING THE SAME

(75) Inventors: Frank Fischer, Lubeck (DE); Martin Hennemann, Bad Schwartau (DE)

(73) Assignee: PATES Technology Patentverwertungsgesellschaft fur Satelliten- und moderne Informationstechnologien mbH, Lubeck (DE)

( * ) Notice: Subject to any disclaimer, the term of this patent is extended or adjusted under 35 U.S.C. 154(b) by 0 days.

(21) Appl. No.: 09/622,559

(22) PCT Filed: Oct. 13, 1998

(86) PCT No.: PCT/EP98/06487

§ 371 (c)(1),
(2), (4) Date: Oct. 16, 2000

(87) PCT Pub. No.: WO99/43047

PCT Pub. Date: Aug. 26, 1999

(30) Foreign Application Priority Data

Feb. 20, 1998 (DE) ..... 198 07 077

(51) Int. Cl.[7] ..... H01Q 13/10
(52) U.S. Cl. ..... 333/21 A; 343/771
(58) Field of Search ..... 333/21 A; 343/771

(56) References Cited

U.S. PATENT DOCUMENTS 3,188,642 A * 6/1965 Bock et al. ..... 343/756
6,166,701 A * 12/2000 Park et al. ..... 343/771

* cited by examiner

*Primary Examiner*—Robert Pascal
*Assistant Examiner*—Joseph Chang
(74) *Attorney, Agent, or Firm*—Richard C. Woodridge, Esq.; Woodbridge & Associates, P.C.

(57) ABSTRACT

The invention relates to a polarizer (1) for electromagnetic radiation. The polarizer (1) has electrically conductive elements (5, 24) arranged in parallel and it a given distance from each other. The elements (5, 24) are held in position by at least one spacer (3, 7, 9, 23). Each spacer (3, 7, 9, 23) is made of a low dielectric material.

22 Claims, 7 Drawing Sheets

POLARIZER AND METHOD FOR MANUFACTURING THE SAME

Figure 1:
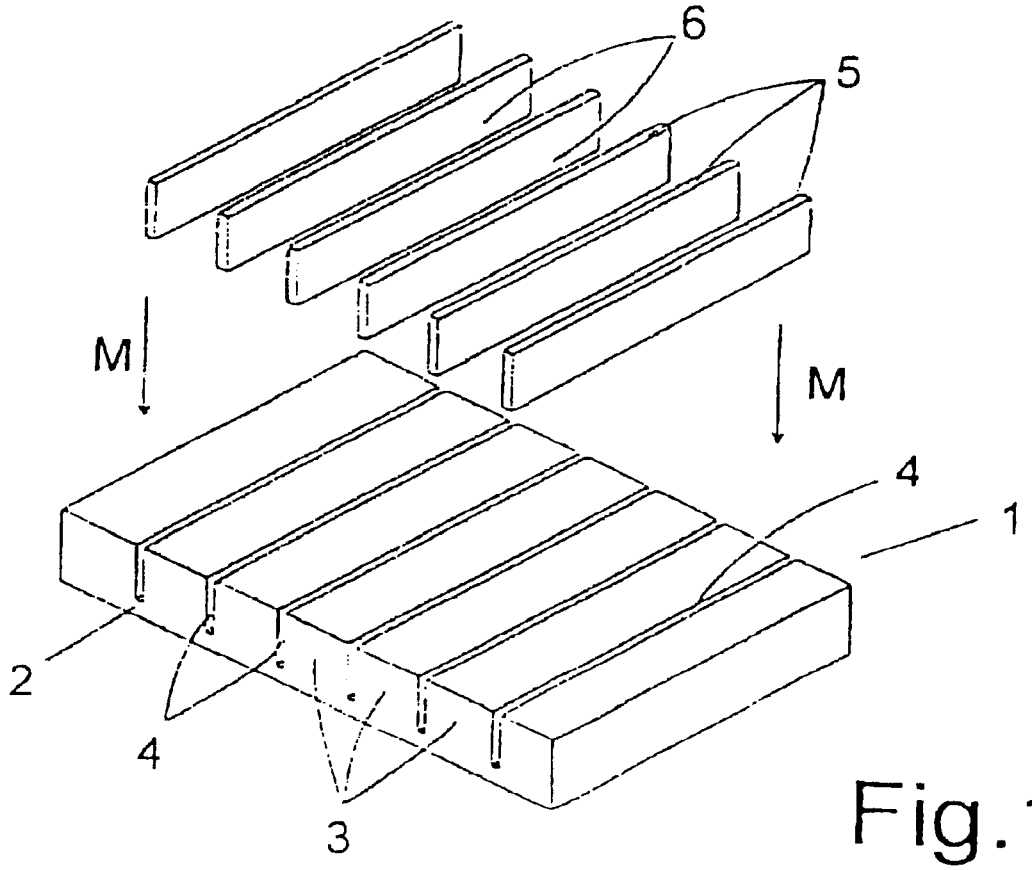

The invention relates to a polarizer for electromagnetic radiation, wherein the polarizer has electrical conductive elements arranged in parallel and in specific distances to one another.

In order to obtain a dual circular right or left polarized electromagnetic wave, planar polarizers that are situated above the radiating antenna opening are used for planar antennas that are arranged as dual linear polarized antennas.

The polarizer breaks up the E-vector of an impinging wave into two orthogonal components and produces a phase difference [spacing phase] of ±90 degrees between the components and which, with subsequent overlay, results in a circular polarization. The mode of action likewise applies to the conversion of a circular into a linear polarization.

Two constructively different types of polarization are known. The one type of polarization uses several Polarization structures arranged in an interval of $\lambda/4$ (quarter lambda) that act on the one hand inductively and on the other hand capacitatively on the respective E-field components and thus produce the phase difference. These polarization structures are often carried out as etched complex folded line circuits on a matrix (foil). In this situation at least two such structures (inductive, capacitative) are required for a polarizer. The required witch or spacing is created by the use of a low dielectric material. The disadvantage in this embodiment is its high sensitivity to engineering tolerances. Likewise, good flatness and very precise positioning of the foils used must be assured. This frequently leads to additional expense in the form of positioning guides for gluing and bonding and where [com]pression of the layers is required.

Another polarization type also uses electrically conductive elements in the form of metal struts [sic] which are arranged at a 45 degree angle to the linear polarization. Due to the different electrical constraints two different field types form and are expanded by the polarizer. Due to the different propagation times a phase difference of ±90 degrees is produced at the output of the polarizer at superpositioning of these phase types and, consequently, a right or left circular wave is produced. The electrical characteristics are determined by the spacing of the metal struts relative to one another and their length in the principal direction of antenna radiation. The metal struts are enclosed in a metal frame and their ends are either bonded or soldered to the frame. The advantage of this type of polarizer is the electrical simplicity and the satisfactory electrical characteristics such as, for example, large frequency bandwidth, relative insensitivity to engineering tolerances, very low insertion loss, very good elliptical [wave] values and adaptation. The disadvantage in this polarizer type is the costly and consequently the expensive fastenings of the metal struts to the frame, since either two bonding- or soldering steps are involved for each metal strut. Moreover, frequently metal stresses are created that are caused by the engineering tolerances at the time of manufacturing the metal struts and when inserting the metal struts into the mounting frame. The mounting frame weight is disproportionally high, since it is most often made of metal.

The purpose of the present invention is, therefore, to provide a polarizer that is simple in construction and economical to manufacture.

The solution to this problem presented on the one hand by a polarizer of the type described earlier and pursuant to the invention in which the elements are held in position by at least one spacer element, wherein each spacer element is made of a low dielectric material. A further solution is offered if the elements are removably or unremovably inserted into a board or strip shaped spacer and are held in position relative to one another by at least one spacer element.

In the polarizer described in the invention the mounting frame is eliminated completely. By doing so, the weight of the polarizer is advantageously reduced. The positioning of the conductive elements which are most frequently fashioned from metal struts or metal strips is achieved by the spacer made of a particularly low dielectric material. Since the recesses provided for accepting the conductive elements are milled, etched or otherwise produced at the same time in the form of grooves, slots or bore holes in the low dielectric material, the spacing and the width or pitch of the grooves or slots relative to one another is always the same and is subject to only low engineering tolerances. This solution represents an essential improvement of the electrical characteristics of the polarizer.

Polystyrol in its foam form, for example, is suitable as the low dielectric material.

It is advantageous to realize the grooves or slots, that are arranged at a 45 degree angle to the linear polarization, somewhat narrower than the conductive elements to assure that the conductive elements do not fall out of the spacer element. By inserting the conductive elements into the grooves or slots the side walls of the slots are pushed apart whereby a compression force is produced which prevents the elements from falling out of the slots. However, this procedure can also result in the occurrence of very high tensions in the spacer that is preferably constructed as a plate or strip. These tensions can be reduced or completely eliminated if additional recesses are provided in the spacer. Said recesses can be placed on the side containing the grooves or slots and/or on the side opposite to same. In this manner, the material that is displaced by the inserted conductive elements can expand without the occurrence of internal stresses within the spacer that would tend to deform it [lit. to "bend" it]. The supplemental recesses can, for example, also be grooves or slots. The shape of the recesses is optional and can be adapted to local requirements.

In order to prevent the metal struts from falling out as conductive elements there is the additional possibility of covering or enveloping the polarizer with the same low dielectric material used in the spacer. This can be done by a bonding process or by coating, application of a foam, or foaming over the surfaces of the grooves or slots.

It is also possible to bond the elements together with the spacer element. In a further advantageous embodiment of the invention the conductive elements do not rest in grooves or slots, but in bore holes into the low dielectric material. Depending on the cross-sectional shape of the conductive elements the borings can be replaced by the recesses adapted to that shape.

The conductive elements can be advantageously prevented from falling out of the grooves or slots in that the depth of the grooves or slots may be larger than the height of the conductive elements in such a manner that each groove or slot together with the element situated in it can be filled or covered with a sealant or filler material and preferably done to be flush with the surface of the spacer element. In this way a flat surface of the polarizer is made possible whereby at the same time the conductive elements are protected from corrosion.

The necessary spacing between the antenna and the conductive elements of the polarizer can be integrated into the overall level of the low dielectric material.

In order to fasten the polarizer to a planar [flat, bedspring] antenna it is sufficient that the already existing external edges of the planar antenna housing be extended and after placement of the polarizer on the antenna it be folded over it so that the polarizer forms a unit with the antenna.

A further advantageous embodiment of the polarizer would be if the interspaces between the conductive elements were partially or completely filled with a low dielectric material. The low dielectric material The low dielectric material can, but does not have to be, the same low dielectric material as that used in the spacer element. It can be pushed in or filled in between the elements at a later time, for example, by a expanding foam-fill process. Inasmuch as the polarizer is of such design that the interspaces between the conductive elements is not filled in, the interspaces need not necessarily be filled in with a low dielectric material. The decision depends essentially on the stability and the electrical characteristics of the polarizer in conjunction with the planar antenna.

In order to assure that the polarizer and the associated flat or planar antenna are constantly in the correct positional relationship to one another, they can, as already described above, be enclosed in a casing or a housing. It is also possible to bond the flat antenna to the polarizer. Furthermore, it is possible the polarizer and the flat antenna and hold them in a position relative to one another by surrounding or imbedding them using a preferably low dielectric material. By surrounding them with foam or imbedding the two components, the two components are advantageously hermetically isolated from the environment so that they are optimally protected from mechanical or atmospheric related influences.

Furthermore, the purpose of the present invention is to provide a method for manufacturing the polarizer described in the invention by means of which the polarizer can be manufactured in the fewest steps and most economically.

This purpose is clearly accomplished in that, first of all, in the spacing element, of which there is at least on and which is made out of a particularly low dielectric material, recesses but especially grooves or slots or borings are milled, etched, cut, sawed, burnt, bored or pressed and then the elements are then inserted, bonded, or compressed into the grooves or slots. It is thus possible to introduce or to insert the elements sequentially or individually into the spacer element.

Inasmuch as there are not recesses for the conductive elements in the spacer element, it is possible to simply impress the elements into the material of the spacer element. When doing this, however, often considerable stresses occur in the material itself, since a relatively large quantity of the material is displaced by the elements. If the conductive elements are properly heated it is possible to bring the material of the spacer element, which is advantageously polystyrol, to melting or burning so that the elements can be impressed into the material of the spacer element with relatively little force, whereby simultaneously hardly any stresses occur in the material of the spacer element.

Depending on the type and the form of the spacer element, the interspaces between the elements after their insertion may not yet be filled in. Said interspaces can then be filled in or foamed in with low dielectric material. It is nonetheless also to insert precisely fitted preformed elements made of low dielectric material into the interspaces so that the interspaces are completely filled.

The manufacture of the polarizer as described in the invention can also be accomplished in that the conductive elements are held in parallel and in the correct spacing to one another and then imbedded or foamed in with a particularly low dielectric material. It is also useful and feasible to arrange the elements in the correct spacing intervals relative to one another and to the flat antenna to imbed or to foam in the elements together with the flat antenna using a suitable material. In this instance the flat antenna does not necessarily have to be included in the integration. It is also possible to produce the polarizer separately from the flat antenna by an imbedding or foaming-in process.

In the following the embodiments as described in the invention are explained in detail using the following drawings.

Figure 2:
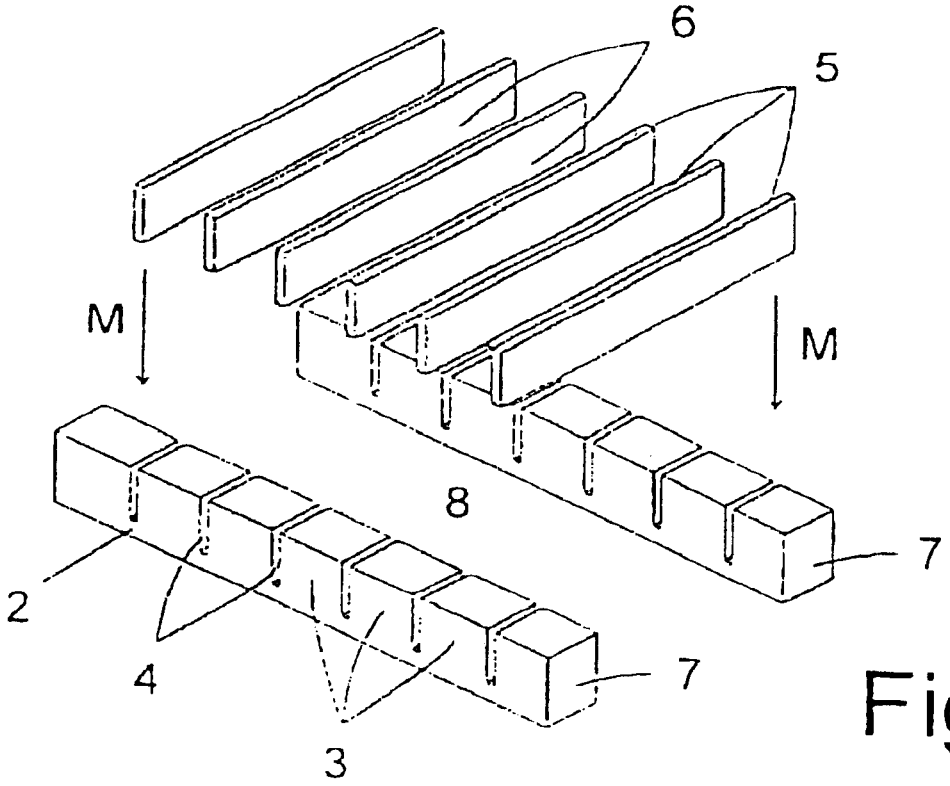
Figure 3:
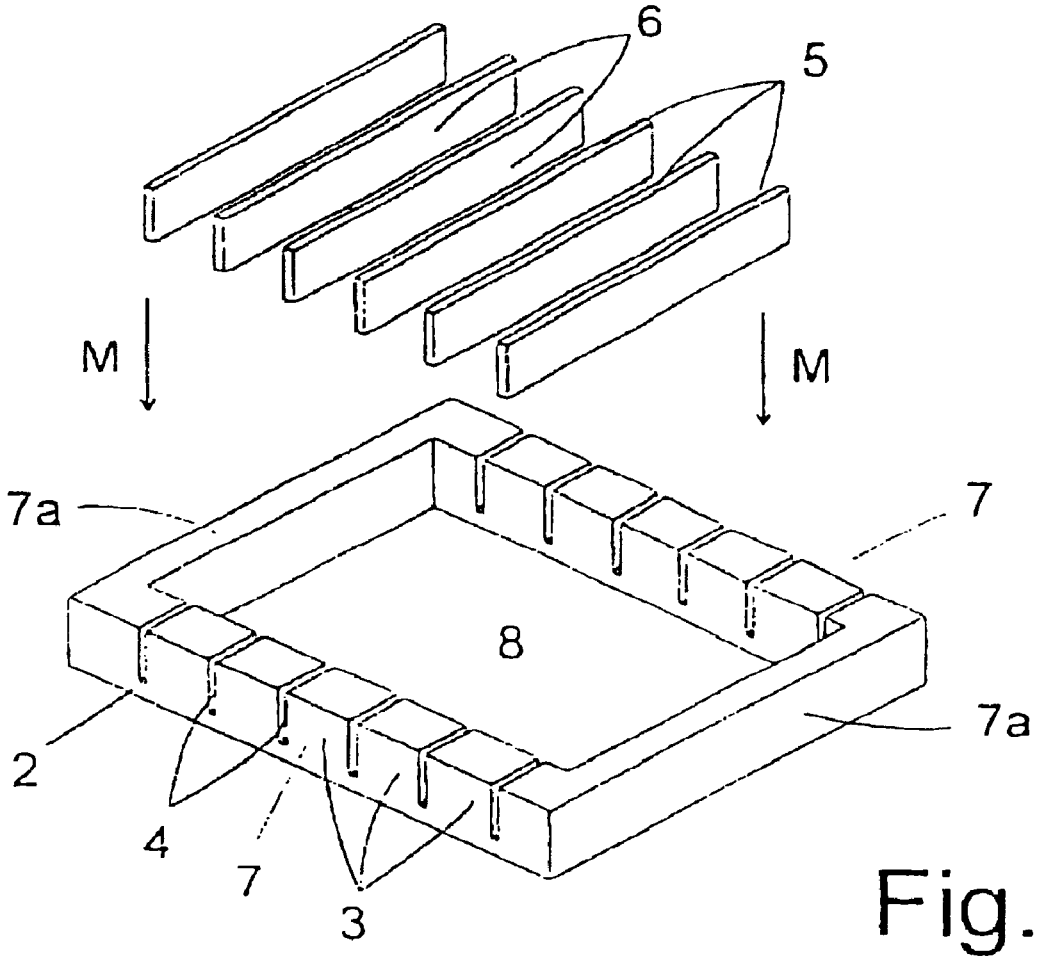
Figure 4:
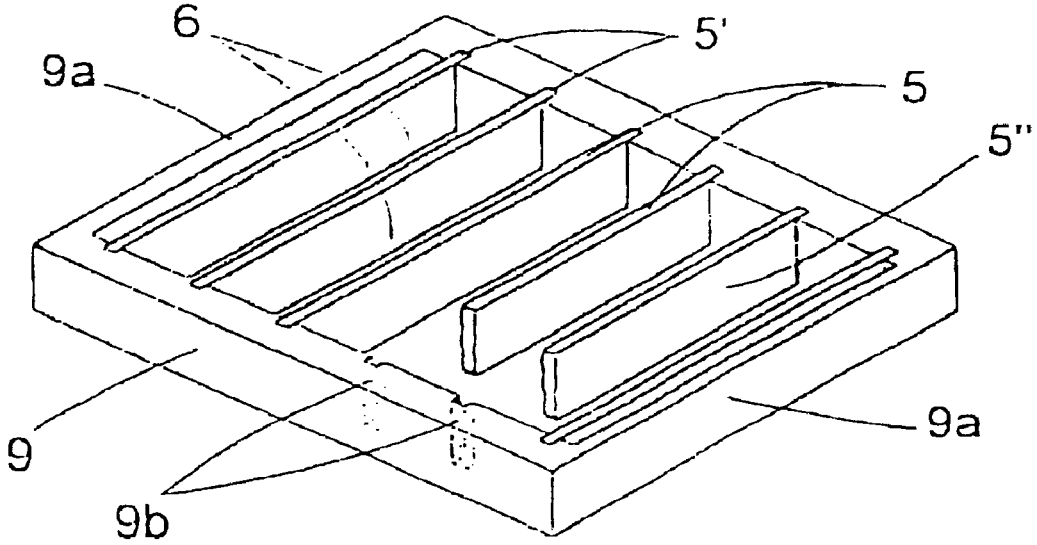
Figure 5:
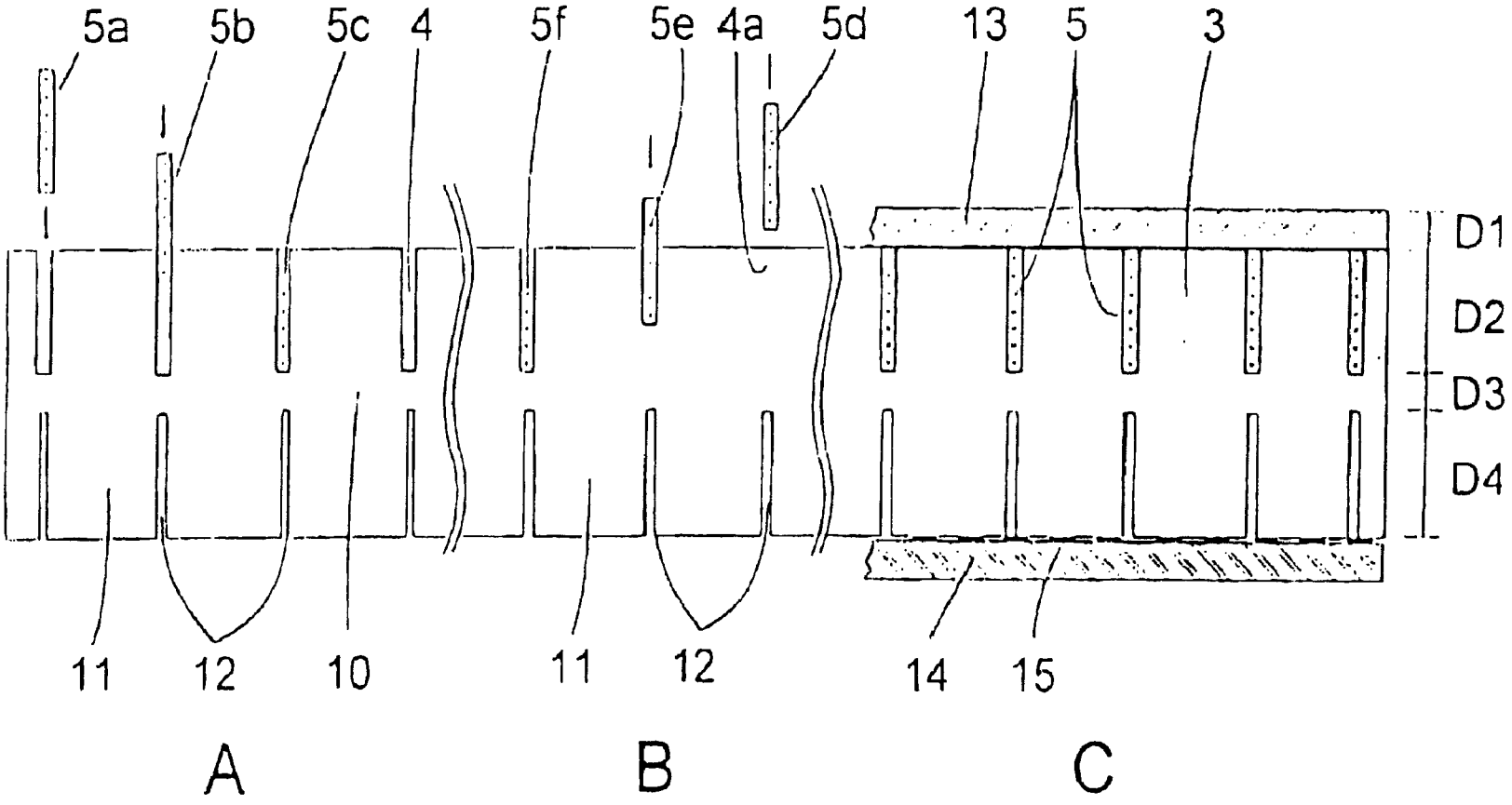
Figure 6:
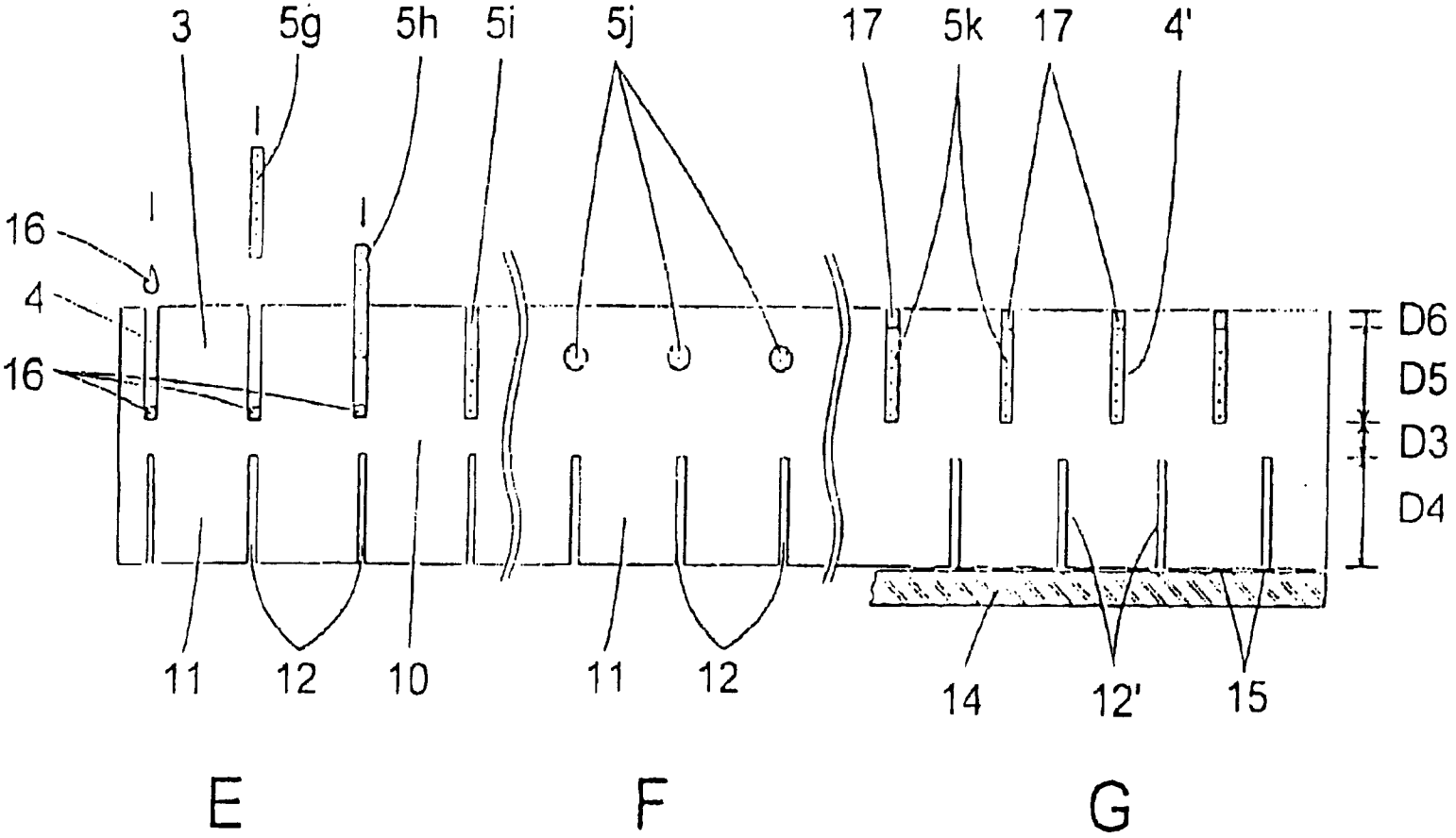
Figure 7:
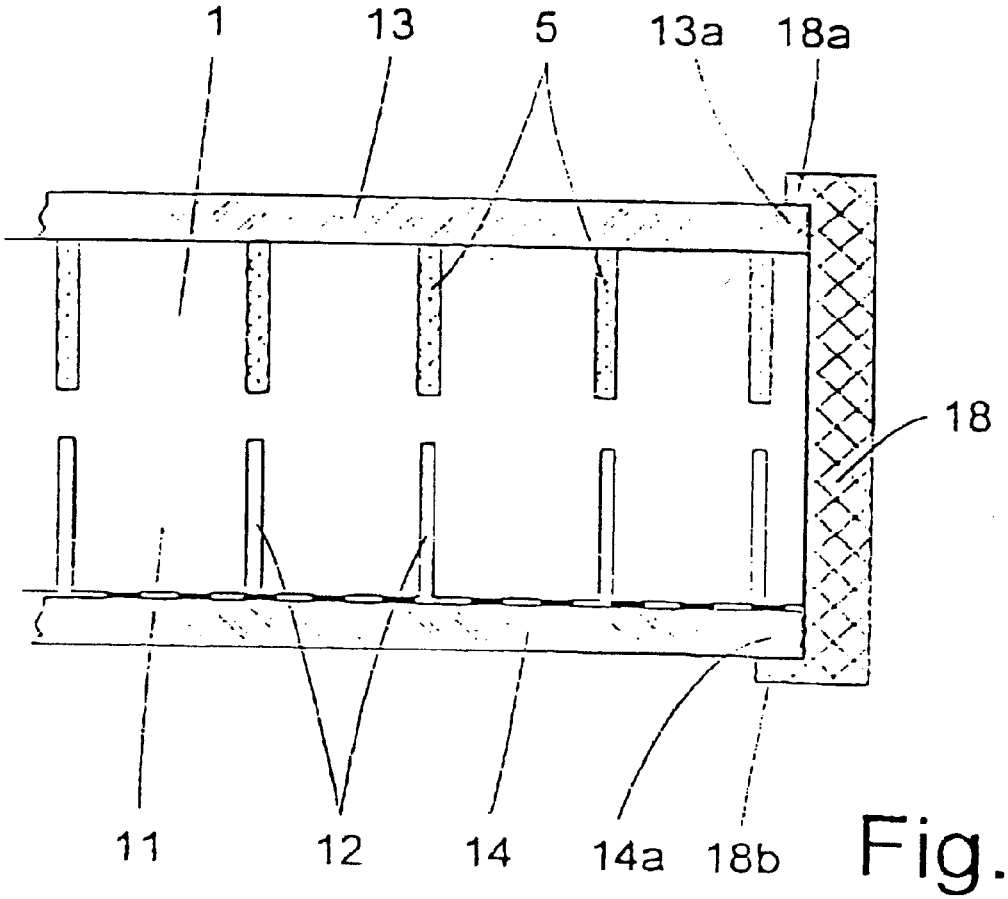
Figure 8:
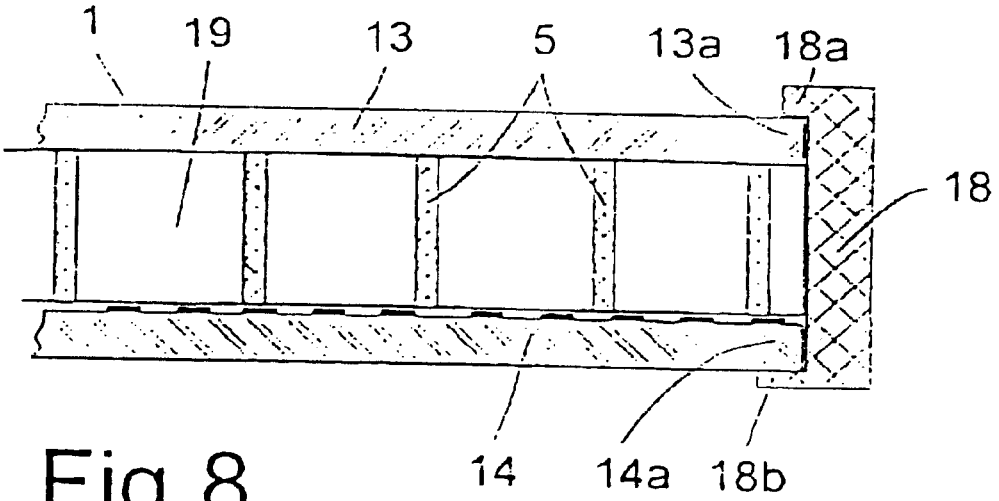
Figure 9:
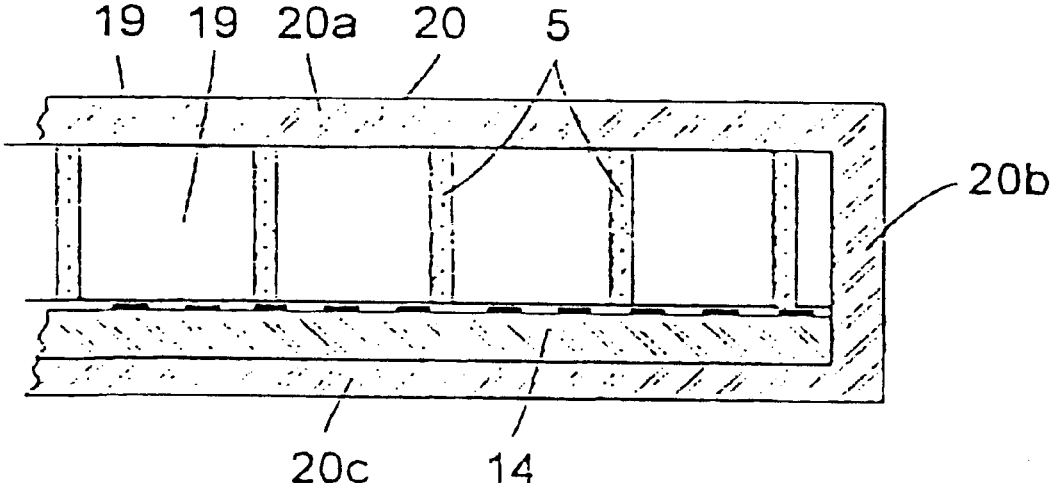
Figure 10:
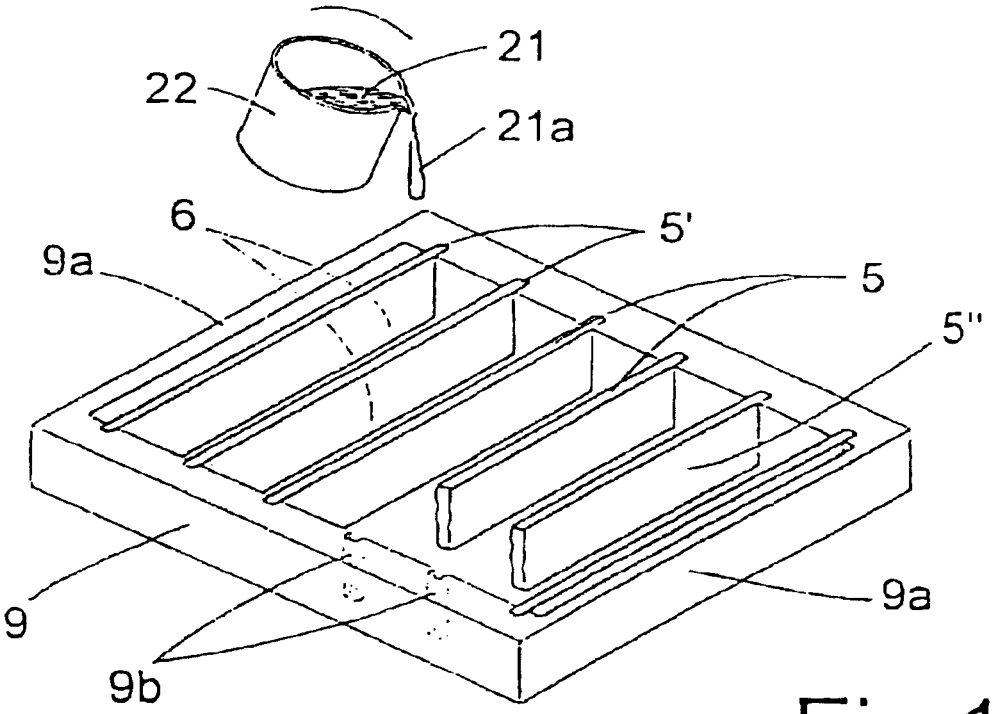
Figure 11:
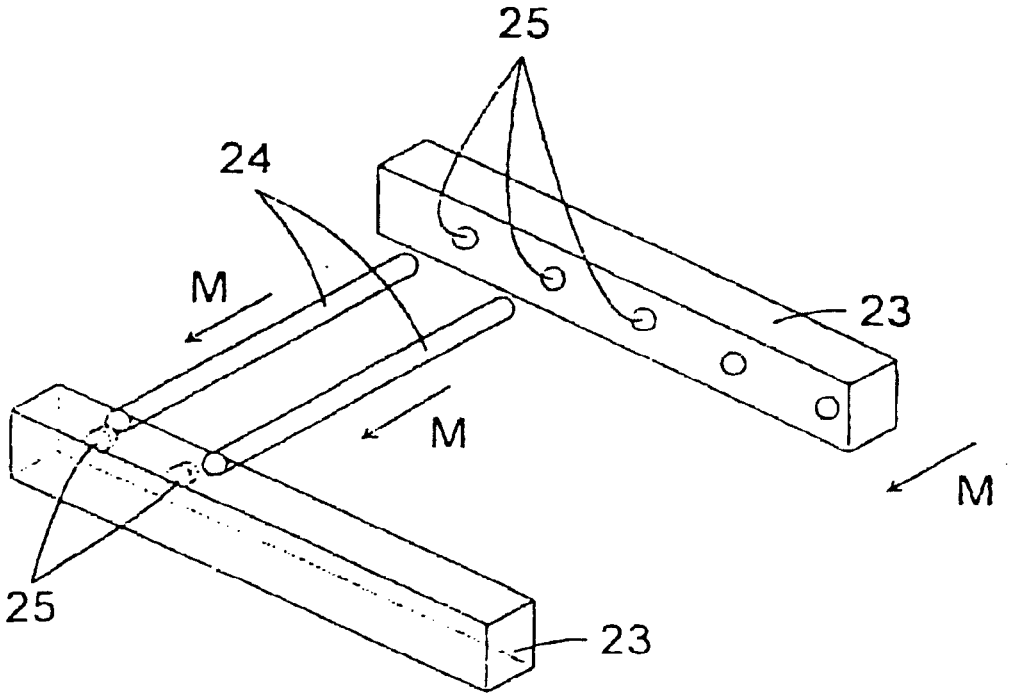

Illustrated in:

FIG. 1: a card-shaped polarizer with grooves or slots to accommodate strip-shaped conductive elements;

FIG. 2: a two-part spacer element with grooves or slots to accommodate conductive elements;

FIGS. 3 and 4: a frame-type spacer element with grooves or slots to accommodate the conductive elements;

FIGS. 5 and 6: manufacturing and construction form of a polarizer as described in the invention;

FIGS. 7 and 8: polarizer and flat antenna in a common housing;

FIG. 9: an imbedded polarizer with flat antenna;

FIG. 10: manufacturing process for a polarizer;

FIG. 11: polarizer with rod-shaped conductive elements.

FIG. 1 illustrates a polarizer (1) exhibiting a plate with longitudinal grooves or slots (4) which divide the plate into individual segments (3) which are used as spacing elements for the conductive elements (5) that are to be inserted and which fill the interspace (6) between the conductive elements in the assembled condition. The individual spacer elements (3) are connected to each other via connecting points (2). The slots (4) have the shape of the conductive elements (5) so that the latter set completely in the slots (4) and do not project beyond the edge of the slots (4). The conductive elements (5) are most simply inserted into the slots in the direction of the arrow identified with M. This can be done individually by hand or also by means of a single machine step.

For further reduction of the weight of the polarizer it is also possible to provide two strip-shaped spacers (7) which accommodate the ends of the conductive elements (5) together with their slots (4). The interspaces (6) of the conductive elements remain free after insertion into the spacer element (7) by virtue of the interspace (8) between the spacer element (7) and the conductive elements (5) that are spaced relative to one another. For the purpose of improved mechanical stabilization of the polarizer the spacer elements (7) can, as shown in FIG. 3, be connected be connected by means of connection walls (7*a*). This is, however, not unconditionally required if the conductive elements in the embodiment illustrated in FIG. 2 is bonded with the spacer elements (7).

FIG. 4 shows a similar frame-type spacer element (9), as shown in FIG. 3, but in this embodiment of the frame slots (9*b*) running perpendicular to the radiation plane are provided to accommodate the elements (5). Only the ends (5') rest in the slots (9*b*) so that again the interspace (6) between the conductive elements (5) is not filled.

Inasmuch as the embodiments shown in FIGS. 2 to 4 exhibit inadequate stability or are insufficiently protected against external, particularly atmospheric effects, it is possible, as shown in FIG. 10, to fill in the interspaces (6) between the conductive elements (5) using a material (21). This can likewise be a low dielectric material. It is, however, also possible imbed the conductive elements together with the spacer element(s) in the material (21) so that the entire polarizer is protected against external influences and is more stable as well.

FIG. 5 illustrates various embodiments A, B, C of the polarizer and their manufacturing methods. In polarizers pursuant to A, initially slots (4) are made into the material of the spacer element (4).

At the same time adjustment recesses (12) can also be provided, for example in the form of slots or grooves in the back wall of the polarizers, so that there is no internal tension or stress caused inside the polarizer at the time of insertion of the conductive elements (5). The adjustment recesses can, however, be provided on the front wall and even in addition on the back wall. The conductive elements (5*a*) is then pressed or inserted into the preformed slot (4) of the spacer element. Inasmuch as the width of the slot is less than the width of the conductive elements, the conductive elements (5) is firmly seated within the slot and cannot simply fall out. Depending on requirements the thicknesses D2 to D4 shown to the right of the polarizer illustrated in FIG. 5 can be correspondingly selected. Using thicknesses D2 and D4 the spacing between the conductive elements and the planar antenna (14) with its radiation elements (15) can be determined.

The area B illustrates a polarizer and its manufacturing method in which adjustment recesses (12) are provided on the rear wall of the polarizer. This is necessary, since no recesses have been provided in the spacer element prior to insertion of the conductive elements (5*d* to 5*f*). The conductive elements (5*d* to 5*f*) are pushed into the spacer element under pressure whereby the material of the spacer element is pushed to the side. It is also possible that the conductive elements (5*d* to 5*f*) might be heated before and/or during their installation into the spacer element such that when the conductive elements makes contact with the material of the spacer element, the material melts or bums and thus make way for the inserted conductive elements.

In area C the conductive elements are installed according to the manufacturing process of Sections A or B into the spacer element. On the side of the polarizer that faces away from the flat antenna (14) a covering or Protective coating (13) has been bonded or otherwise applied to the spacer element together with the conductive elements (5) installed in it. The covering (13) serves as a protection against corrosion for the conductive elements and additionally serves in stabilizing the mechanical characteristics of the polarizer. The thickness D1 of the covering layer (13) can be freely selected.

FIG. 6 likewise illustrates manufacturing and design variations of the polarizer as described in the invention. In the region of the polarizer identified with E it is emphasized that initially slots (4) for accommodation of the conductive elements (5*g* to 5*j*) have been created, whereupon an adhesive (6) has been sprayed into the slots (4). It is nevertheless conceivable that the conductive elements (5*g* to 5*j*) could be coated with the adhesive (16) before their insertion into the spacer element. By using the adhesive, the possibility of the conductive elements (5*g* to 5*j*) after installation and after the lapse of the hardening period is eliminated. The adjustment slots (12) are optional.

Area F illustrates another embodiment of a polarizer, in which the conductive elements are seated in channel-like recesses. The channel-like recesses can be, for example, bore holes or dead-end borings that run parallel to one another and to the radiation plane of the flat antenna (14). After the channel-like recesses have been created, the rod-like conductive elements with particularly circular cross-section are pushed into the appropriately formed recesses. In this instance the conductive elements (5*j*) can, as shown in the left section of the illustration, likewise be bonded to the spacer element. Also, the borings or the dead-end bore holes can be later sealed off.

Area G illustrates another embodiment I which the adjustment recesses (12') are arranged in an offset to the conductive elements (5*k*). I this instance, the conductive elements (5*k*) lie completely in the slots (4'). The area above the conductive elements (5*k*) in the slots (4') is filled in after installation of the conductive elements (5*k*) using a filler material which is in particular an identical material to the material of the spacer element. The thickness D6 of said layer, together with the height D5 of the conductive elements, corresponds to the height of the slots (4'). In this embodiment it is not unconditionally necessary to provide a covering over the polarizer as illustrated in FIG. 5.

FIG. 7 illustrates a cross-sectional view of the shared housing (18) which laterally overlaps the flat antenna (14) and the polarizer (1) and, to the extent the flat antenna (14) is not bonded to the polarizer (1), holds them together. The housing (18) can for example be fashioned out of aluminum whereby the housing is wound as strips laterally around the configuration consisting of the polarizer (1) and the flat antenna (14), whereupon the lateral edges (18*a* and 18*b*) of the strip are folded over the edges (13*a* and 14*a*). It is, however, also feasible to fashion the housing (18) as a can or bowl-shaped part into which the configuration consisting of the flat antenna (14) and the polarizer (1) are placed and thereafter the top edges of the can or bowl-like part is folded over the edge (13*a*) of the cover of the polarizer.

FIG. 8 illustrates a polarizer (1) which corresponds to the embodiments as shown in FIGS. 1 to 4 and 10, wherein a housing (18) as shown in FIG. 7 is also provided. FIG. 9 illustrates a shared housing (20) for the polarizer (1) and the flat antenna (14) whereby the housing consisting of the lateral walls (20*a* to 20*c*) is an injection molded housing. In the manufacture of this injection molded housing the configuration of flat antenna (14) and polarizer (1) can either be immediately sprayed with the material of the housing (2) or the housing (2) is supplied in at least two parts, whereby after assembly of the housing (20) the configuration is installed in the housing.

FIG. 11 illustrates another polarizer in which two rodlike spacer elements (23) are arranged parallel to one another. The rodlike spacer elements (23) have pocket-bores [=dead-end bore holes] in equidistant intervals for the accommodation of the ends of the conductive elements (24). After assembly this polarizer can also be foamed-in or imbedded in a material whereby the mechanical stability of the polarizer is enhanced.

The manner in which the conductive elements are installed in the respective spacer element is determined by the shape of the conductive elements themselves. Inasmuch as the polystyrol material is used for the spacer element, the recesses that must be provided for the conductive elements can be created relatively easily. Thus the required slots can be created at the same time, for example, by using several saw blades that are arranged in parallel to each other. It is also possible in certain embodiments to produce a very large board with very imbedded conductive elements which later can be divided up into segments that correspond to the respective sizes for flat antennas.

LIST OF REFERENCE SYMBOLS USED

1 Polarizer
2 Connection points between the distance elements (23) of the spacer element
3 Distance element
4 Recesses/Grooves or Slots
4*a* Spacer element area in which the conductive elements are inserted
5 Conductive elements
5' Ends of the conductive elements (5) lying inside the grooves or slots
5" The flat sides forming the interspaces (6)
5*a*, 5*b*, 5*c* Conductive elements (5) of Area A
5*d*, 5*e*, 5*f* Conductive elements (5) of Area B
5*g*, 5*h*, 5*i* Conductive elements (5) of Area E
5*j* Conductive elements (5) of Area F
5*k* Conductive elements (5) of Area G
6 Interspace between the conductive elements (5)
7 Strip-like spacers
7*a* Connection sides of the strip-like spacers (7)
8 Interspace between the strip-like spacer (7)
9 Frame-like spacer element with grooves/slots (9*b*) running perpendicular to the radiation plane for accommodation of the conductive elements (5)
9*a* Connection sides without grooves or slots
9*b* Mounting slots
10 Area between seated elements and adjustment recesses (12)
11 Area between the adjustment recesses
12 Adjustment recesses or adjustment slots
13 Covering of the conductive elements
13*a* Overlapping edge of the covering (13)
14 Flat antenna
14*a* Overlapping edge of the flat antenna (14)
15 Radiation element of the flat antenna (14)
16 Adhesive
17 Sealant material
18 Shared housing for flat antenna (14) and polarizer
18*a*, 18*b* Overlapping edge of the housing (18)
19 Filler material between the conductive elements (5)
20 Housing enclosing polarizer and flat antenna
20*a*, 20*b*, 20*c* Side walls of the injection molded housing (20)
21 Filler material in container
21*a* Filler material
22 Container
23 Rodlike spacers (in two parts)
24 Conductive elements
25 Pocket-bores for accommodation of the conductive elements (24)
A Spacer with preformed slots
B Spacer without preformed slots
C Polarizer with cover
D1 Thickness of covering (13)
D2, D5 Height of the conductive elements (5)
D3 Spacing between the slots (4) and the adjustment recesses (12)
D4 Height of the adjustment recesses (12)
D6 Height of the sealant material (17) filling the slots
E Spacer with bonded conductive elements
spacer with rodlike conductive elements
Spacer with the adjustment recesses arranged in offset to the conductive elements, wherein in addition the slots are filled with sealant material
Direction of insertion of the conductive elements (5)

What is claimed is:

1. A polarizer for electromagnetic radiation, wherein the polarizer has electrically conductive elements that are arranged in parallel in specific spacing to each other and characterized by the fact that the conductive elements are held in position by at least one spacer element, wherein each spacer element is made of a continuous piece of low dielectric material and that each spacer element is provided with at least two recesses, into which the conductive elements are inserted.

2. A polarizer as described in claim 1 and characterized by the fact that the interstices between the conductive elements are entirely or partially filled out with a low dielectric material.

3. A polarizer as described in claim 1 and characterized by the fact that the interstitial space is occupied by at least partially by one spacer element.

4. A polarizer as described in claim 1 characterized by the fact that the conductive elements are glued to the spacer element.

5. A polarizer as described in claim 1 characterized by the fact that the depth of the recesses manufactured as grooves or slots corresponds to the height of the conductive elements.

6. A polarizer as described in claim 1 and characterized by the fact that the depth of the grooves or slots is greater that the height of the conductive elements such that each groove or slot together with the conductive element it contains can be filled or closed off using a sealant material, particularly level with the surface of the spacer elements.

7. A polarizer as described in claim 1 and characterized by the fact that the spacer elements are provided with bore holes into which the conductive elements are inserted removably or unremovably.

8. A polarizer as described in claim 1 and characterized by the fact that the spacer elements has adjustment recesses and or hollow spaces that are arranged on the front or back side of the spacer element and/or which are situated in the spacer element, in particular on the side facing away from the side containing the conductive elements, wherein in particular the recesses are adjustment slots and/or adjustment bore holes.

9. A polarizer as described in claim 1 and characterized by the fact that the polarizer on its side facing away from the antenna is provided with a protective covering against mechanical and/or atmospheric influences and/or for the purpose of corrosion resistance closure of the conductive elements.

10. A polarizer as described in claim 1 and characterized by the fact that the polarizer and the associated flat antenna are embedded or cast into a particularly low dielectric material.

11. A process for the manufacture of a polarizer as described in claim 2 and characterized by the fact that initially in at least one of the spacer elements made of particularly low dielectric material recesses, in particular grooves or bore holes are milled, etched, cut, sawed, burnt, bored, or pressed and then the conductive element are inserted, bonded, compressed or depressed into the recesses.

12. A process for the manufacture of a polarizer as described in claim 1 and characterized by the fact that before, after or during the production of the recesses accommodating the conductive elements, the adjustment recesses, in particular adjustment grooves, are milled, etched, cut, sawed, burnt or pressed.

13. A process for the manufacture of a polarizer as described in claim 1 and characterized by the fact that the conductive elements individually or sequentially are impressed or inserted into the spacer element(s), whereby the conductive elements are arranged in parallel and in a specific interval to each other.

14. A polarizer as described in claim 1 and characterized by the fact that the polarizer lies directly upon the flat antenna.

15. A polarizer as described in claim 14 and characterized by the fact that the polarizer is bonded to the flat antenna.

16. A polarizer as described in claim 14 and characterized by the fact that the polarizer and the flat antenna are arranged in one housing.

17. A process for the manufacture of a polarizer as described in claim 1 and characterized by the fact that the conductive elements, prior to their emplacement in the spacer element(s) are heated sufficiently that the material of the spacer element(s) on contact with the heated conductive elements melts or bums and thus recesses for the conductive elements are formed.

18. A process for the manufacture of a polarizer as described in claim 17 and characterized by the fact that after placement of the conductive elements into the spacer element(s) the interstitial spaces between the conductive elements are filled or foamed in using a low dielectric material.

19. A process for the manufacture of a polarizer as described in the foregoing claim 14 and characterized by the fact that in addition to the interstitial spaces the spacer elements arid the conductive elements are completely covered or foamed over.

20. A process for the manufacture of a polarizer as described in claim 19 and characterized by the fact that after the bonding of the spacer elements and The associated flat antenna both are covered or foamed over with a particularly low dielectric material.

21. A polarizer for electromagnetic radiation, wherein the polarize has electrically conductive elements that are arranged in parallel in specific spacing to each other and characterized by the fact that the conductive elements lie in at least one continuous flat or strip shaped spacer element having at least two recesses and are held in position relative to each other by at least one spacer element.

22. A polarizer as described in claim 21 and characterized by the fact that the spacer element is made of a low dielectric material.

* * * * *